US010501859B2

(12) United States Patent
Kim et al.

(10) Patent No.: US 10,501,859 B2
(45) Date of Patent: Dec. 10, 2019

(54) PARTIAL PLATING METHOD OF AUTOMOBILE RESIN PART AND AUTOMOBILE RESIN PART PLATED BY USING THE SAME

(71) Applicants: Hyundai Motor Company, Seoul (KR); SAMSHIN CHEMICAL CO., LTD., Ansan-si (KR)

(72) Inventors: Hyun-Gyung Kim, Hwaseong-si (KR); Woo-Taik Oh, Ansan-si (KR)

(73) Assignees: Hyundai Motor Company, Seoul (KR); SAMSHIN CHEMICAL CO., LTD., Ansan-si (KR)

( * ) Notice: Subject to any disclaimer, the term of this patent is extended or adjusted under 35 U.S.C. 154(b) by 0 days.

(21) Appl. No.: 15/379,128

(22) Filed: Dec. 14, 2016

(65) Prior Publication Data

US 2018/0119303 A1 May 3, 2018

(30) Foreign Application Priority Data

Oct. 31, 2016 (KR) ..... 10-2016-0143522

(51) Int. Cl.

| | |
|---|---|
| ***C25D 5/02*** | (2006.01) |
| ***C25D 5/54*** | (2006.01) |
| ***C23C 18/16*** | (2006.01) |
| ***C23C 18/20*** | (2006.01) |
| ***C23C 18/22*** | (2006.01) |

(Continued)

(52) U.S. Cl.

CPC ..... *C25D 5/022* (2013.01); *C23C 18/1605* (2013.01); *C23C 18/1653* (2013.01); *C25D 5/54* (2013.01); *C23C 18/2086* (2013.01); *C23C 18/22* (2013.01); *C23C 18/30* (2013.01); *C23C 18/32* (2013.01)

(58) Field of Classification Search

CPC ..... C25D 5/022; C25D 5/54; C23C 18/1653; C23C 18/11605; C23C 18/32; C23C 18/30; C23C 18/2086; C23C 18/22

See application file for complete search history.

(56) References Cited

U.S. PATENT DOCUMENTS 3,043,792 A * 7/1962 Hurwitz ..... C08K 5/12 524/298
3,854,890 A * 12/1974 Akamatsu ..... C25D 5/02 428/601

(Continued)

FOREIGN PATENT DOCUMENTS

JP 6-233950 A 8/1994
JP H08-048933 A 2/1996

(Continued)

*Primary Examiner* — Louis J Rufo

(74) *Attorney, Agent, or Firm* — Morgan, Lewis & Bockius LLP

(57) ABSTRACT

A partial plating method of an automobile resin part may include a painting step of partially applying masking paint for plating on one side surface of an injection molded automobile resin product to form a painting portion where the masking paint for plating is applied and a non-painting portion where the masking paint for plating is not applied, and a wet electroplating step of attaching a current electrode for wet electroplating on the non-painting portion and performing the wet electroplating to form a plating layer on the entire surface of the automobile resin part except for the painting portion.

5 Claims, 4 Drawing Sheets

(51) Int. Cl.
*C23C 18/30* (2006.01)
*C23C 18/32* (2006.01)

(56) References Cited

U.S. PATENT DOCUMENTS 4,404,318 A * 9/1983 Higuchi ..... C09D 7/45
524/588
2003/0012968 A1* 1/2003 Phu ..... B29C 45/0053
428/458
2010/0068465 A1* 3/2010 Su ..... C25D 5/02
428/166

FOREIGN PATENT DOCUMENTS

KR 10-2004-0060884 A 7/2004
KR 10-1018279 B1 2/2011

* cited by examiner

PARTIAL PLATING METHOD OF AUTOMOBILE RESIN PART AND AUTOMOBILE RESIN PART PLATED BY USING THE SAME

CROSS-REFERENCE(S) TO RELATED APPLICATIONS

The present application claims priority to Korean Patent Application No. 10-2016-0143522, filed Oct. 31, 2016, the entire contents of which is incorporated herein for all purposes by this reference.

BACKGROUND OF THE INVENTION

Field of the Invention

The present invention relates to a partial plating method, and more particularly, to a partial plating method of an automobile resin part capable of dividing an injection-molded automobile resin part into a painting portion and a non-painting portion to partially apply paint, and performing wet electroplating to thereby allow only a portion of the automobile resin part to be plated, and an automobile resin part plated by using the same.

Description of Related Art

Exterior components mounted at an outer portion of a vehicle include a bumper, a front grill, components around a vehicle body, components around a tire, and the like. In accordance with development of a plastic technology capable of exhibiting excellent strength, heat resistance, and thermal conductivity comparable to metal, most of such exterior components use plastic instead of metal as a light-weight material in a vehicle for improving fuel efficiency to meet environmental regulations, and use of plastics in automobile parts gradually increases.

Particularly, as consumer's requirements for exterior components of a vehicle are gradually diversified and differentiation of design and function proceeds for each vehicle manufacturers, importance of a plastic surface treatment technology for improving appearance of plastic components to diversify product designs and improve quality and securing durability such as weather resistance, heat resistance, water resistance, or the like to prolong lifespan of automobile parts and improve safety, is being emphasized.

In order to reduce weight and cost of products by decreasing consumption of other materials in accordance with diversified sizes and shapes of products, a surface treatment technology such as painting or plating in which high-gloss surface treatment, matte surface treatment, pattern formation, or the like is performed only on a portion requiring the treatment, has been developed and used as the plastic surface treatment technology.

Japanese Patent Laid-Open Publication No. 1994-233950 as an example of the existing surface treatment technology for partial plating suggests a method of plating a workpiece having a complicated shape by roughly attaching masking material to the workpiece, performing painting, and removing the masking material. In this case, however, since the painting is performed on the masking material, painting area is excessively large. Thus, it is not possible to reduce weight and cost. Further, since an adhesive for roughly attaching the masking material is separately used, appearance after plating may be defective.

Further, Korean Patent Publication No. 10-1018279 discloses a partial plating method for a plastic injection molded product capable of performing partial plating by masking a portion to be plated in the plastic injection molded product, coating the masked plastic injection molded product, and performing plating.

However, in Korean Patent Publication No. 10-1018279, masking material needs to form an assembly structure at front and rear portions of each component, and a coating process is performed on the exterior of the masking material at the front and rear portions of each component, and inner and outer portions of the injection molded product. As a result, manual processes are increased such that productivity deteriorates. Further, since the coating process is performed even on the exterior of the masking material that does not need to be coated, coating area becomes excessively large, thereby increasing coating material cost in contrast to decreased plating cost. In addition, in a wet electroplating process, since a space in which a battery is to be attached is insufficient, a battery attaching part may not be properly formed in a component, thereby causing plating defect.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a partial plating method of an automobile resin part capable of dividing an automobile resin part into a painting portion and a non-painting portion in accordance with various shapes of products to partially apply masking paint for plating by screening, and performing wet electroplating to thereby allow only the non-painting portion where the paint is not applied to be plated, and an automobile resin part plated by using the same.

Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

In accordance with an exemplary embodiment of the present invention, a partial plating method of an automobile resin part includes: a painting step S100 of partially applying masking paint for plating only on an area not requiring plating in one side surface of the automobile resin part to form a painting portion where the masking paint for plating is applied and a non-painting portion where the masking paint for plating is not applied, and a wet electroplating step S200 of attaching a current electrode through which current for electroplating flows on the non-painting portion and performing wet electroplating to form a plating layer on the entire surface of the automobile resin part except for the painting portion.

In the wet electroplating step S200, the plating layer may not be formed on the painting portion since the wet electroplating is not performed on the painting portion due to the masking paint for plating.

In the painting step, the masking paint for plating may be applied on the surface of the automobile resin part at a thickness of 20 to 30 μm, preferably, 25 μm.

The wet electroplating step may include a pre-treating step S210 of activating chemical plating by adsorbing a metal catalyst so that the chemical plating is performed on the surface of the automobile resin part, a chemical plating step S220 of forming a conductor capable of performing electroplating by using chemical nickel by the metal catalyst, and an electroplating step S230 of plating the automobile resin part gone through the chemical plating step using copper (Cu), nickel (Ni), and chromium (Cr).

In the wet electroplating step, the pre-treating step may include a degreasing step S211 of immersing the automobile resin part in a degreasing solution to remove dust or a greasy substance from the surface of the automobile resin part, an etching step S212 of immersing the degreased automobile resin part in an etching solution to form fine grooves on the surface of the automobile resin part, a neutralizing step S213 of neutralizing the etching solution remaining on the surface of the automobile resin part, and an activating step S214 of adsorbing the metal catalyst in the fine grooves formed in the etching step.

After the painting step and before the wet electroplating step, a drying step of drying the applied paint through hot-air drying and natural drying may be further included, and The applied paint may be hot-air dried for 30 minutes and naturally dried for 3 minutes, but the drying step is not limited thereto, but may be variously modified and performed by those skilled in the art.

The masking paint for plating that is applied on the surface of the automobile resin part may contain a masking resin composition for plating containing a polymer resin, an organic solvent, a plasticizer, and an inorganic additive.

In the masking resin composition for plating, the polymer resin may be poly vinyl chloride (PVC) or a mixture of poly vinyl chloride (PVC) and an ethylene-vinyl acetate copolymer (EVA).

The organic solvent may include any one or more selected from methyl isobutyl ketone, toluene, n-butanol, and ethylacetate.

The plasticizer may be trioctyl benzene-1,3,5-tricarboxylate.

The inorganic additive may include any one or more selected from sodium (Na), aluminum (Al), potassium (K), calcium (Ca), titanium (Ti), and iron (Fe).

A concentration of the masking resin composition for plating may be 60 wt % or more and 99 wt % or less in the masking paint for plating.

In accordance with another exemplary embodiment of the present invention, an automobile resin part formed using the partial plating method as described above is an automobile part in which masking paint for plating is partially applied only on a portion not requiring the plating in one side surface of the automobile resin part to form a painting portion where the masking paint for plating is applied and a non-painting portion where the masking paint for plating is not applied, and wet electroplating is performed to form a plating layer on the surface except for the painting portion.

The automobile resin part may be a part molded using a synthetic resin, and may preferably include a radiator grille or a lamp housing. Here, the synthetic resin may be an acrylonitrile-butadiene-styrene (ABS) resin.

The partial painting method according to an exemplary embodiment of the present invention is not limited to be used for the above suggested parts, but may be easily used for various automobile parts by a person having ordinary skill in the art to which the present invention pertains.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
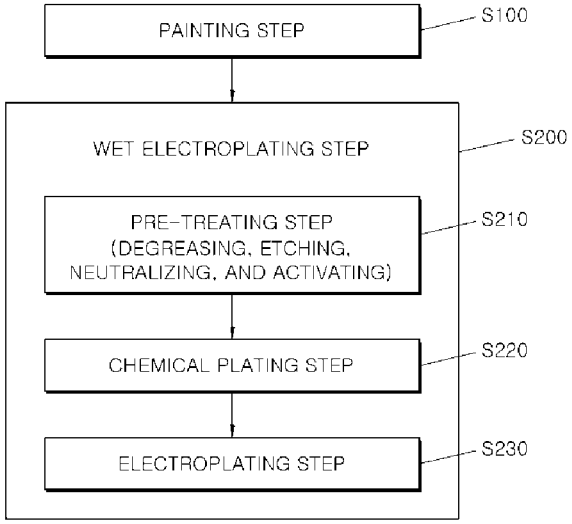
FIG. 1 is a flowchart illustrating a process of a partial plating method of an automobile resin part in accordance with an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

In the specification, it is to be noted that the terms "comprising", "including", or "adding", and the like, are not construed as necessarily including all of several components or several steps described in the specification but should be construed that some of the above components or steps may not be included or additional components or steps may be further included.

Further, in the partial plating method of an automobile resin part according to an exemplary embodiment of the present invention, the number of repetition of each step, process conditions, and the like that are described in the specification are not particularly limited unless departing from the object of the present invention.

Figure 2:
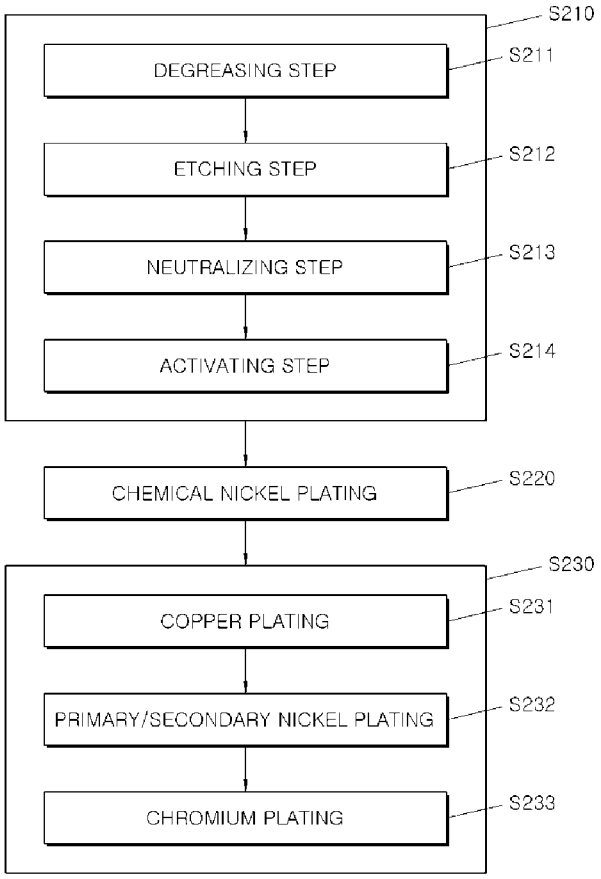
FIG. 2 is a flowchart illustrating a process of a wet electroplating step in the partial plating method of an automobile resin part in accordance with an exemplary embodiment of the present invention.

FIG. 1 and FIG. 2 illustrate a process of a partial plating method of an automobile resin part an exemplary embodiment according to an exemplary embodiment of the present invention. As illustrated in FIG. 1, a partial plating method of an automobile resin part according to an exemplary embodiment of the present invention includes a painting step S100 of applying paint on a portion of a surface of the automobile resin part, and a wet electroplating step S200.

As an example, the painting step S100 is a step of partially applying masking paint for plating only on an area not requiring plating in one side surface of the automobile resin part that is molded using an acrylonitrile-butadiene-styrene (ABS) resin to divide the automobile resin part into a painting portion where the masking paint for plating is applied and a non-painting portion where the masking paint for plating is not applied.

The masking paint for plating used in the painting step contains a masking resin composition for plating, in which the masking resin composition for plating contains a polymer resin, an organic solvent, a plasticizer, and an inorganic additive.

The polymer resin is poly vinyl chloride (PVC) or a mixture of poly vinyl chloride (PVC) and an ethylene-vinyl acetate copolymer (EVA).

In the mixture of poly vinyl chloride (PVC) and the ethylene-vinyl acetate copolymer (EVA), the ethylene-vinyl acetate copolymer (EVA) is a bonding structure of poly vinyl chloride and serves to perform cross-linking.

The organic solvent may be any one selected from methyl isobutyl ketone, toluene, n-butanol, and ethylacetate, or a mixture of two or more thereof.

The plasticizer may preferably be trioctyl benzene-1,3,5-tricarboxylate.

The inorganic additive may include sodium (Na), aluminum (Al), potassium (K), calcium (Ca), titanium (Ti), and iron (Fe).

As an example, the masking resin composition for plating may be contained in a content as shown in Table 1 below.

TABLE 1

| Composition | Content (wt %) | Components |
|---|---|---|
| Polymer resin | 87.67 | PVC + EVA |
| Organic solvent and plasticizer | 3.61 | Organic solvent Methyl isobutyl ketone(40 wt %), toluene(31 wt %), n-butanol(14.7 wt %), ethylacetate(13 wt %) |
| | | Plasticizer Trioctyl benzene-1,3,5-tricarboxylate(95 wt %) |
| Inorganic additive | 8.72 | Na (0.017 wt %), Al (0.0014 wt %), K (0.0024 wt %), Ca (0.004 wt %), Ti (0.0023 wt %), Fe (0.004 wt %) |

The masking paint for plating may further contain water, and a content of the masking resin composition for plating is 60 wt % or more and 99 wt % or less in the masking paint for plating.

When the content of the masking resin composition for plating is less than 60 wt % based on a total weight of the masking paint for plating, since a concentration of poly vinyl chloride (PVC) that is a polymer resin is low, the paint becomes watery, such that it is difficult to perform the painting step since the paint flows down, and at the time of performing the wet electroplating, plating burrs are generated at a connection portion of a current electrode. Further, when the content of the masking resin composition for plating is greater than 99 wt %, since the concentration of poly vinyl chloride (PVC) is relatively high, the painted surface may not be smooth but rough.

Further, in the painting step S100, the masking paint for plating may be selectively applied on the surface of the automobile resin part using a spray method or using a brush according to setting by a user. Here, the masking paint for plating is applied at a thickness of 20 to 30 μm, most preferably, 25 μm.

When the thickness of the applied masking paint for plating is less than 20 μm, since the thickness of the paint is thin, the painting portion and the non-painting portion are not properly divided, such that formation of a plating layer on the painting portion may not be controlled. As a result, partial plating is not properly performed. Meanwhile, when the thickness of the applied masking paint for plating is greater than 30 μm, the number of painting operations for increasing the thickness of the paint is increased, thus a large amount of time is required for performing the operations. As a result, workability and productivity may deteriorate.

After the painting step S100, the wet electroplating step S200 is performed. The wet electroplating step S200 is a step of forming the plating layer on the surface of the automobile resin part, and as shown in FIG. 2, includes a pre-treating step S210, a chemical plating step S220, and an electroplating step S230 to form the plating layer on the surface of the automobile resin part.

In the pre-treating step S210, a degreasing step S211, an etching step S212, a neutralizing step S210, an activating step S214, etc. may be performed.

The degreasing step S211 is a step of removing dust or a greasy substance remaining on the surface of the automobile resin part. As an example, in the degreasing step, a synthetic resin product may be immersed in a degreasing solution that is prepared by mixing water and sodium metasilicate for 5 to 10 minutes to degrease a surface of the synthetic resin product, but the degreasing step is not limited thereto. The greasy substances including oil on the surface may be removed under various conditions.

The etching step S212 is a step of forming fine grooves on the surface of the automobile resin part by immersing the automobile resin part in an etching solution capable of selectively dissolving rubber component of the ABS resin that is a material for the automobile resin part, to improve adhesion of plating on the degreased automobile resin part. The etching solution used herein is not limited but any one may be used as long as it may etch the surface of the automobile resin part including the ABS resin material.

After the etching step, a washing step may be carried out to remove the etching solution remaining on the surface of the automobile resin part, and when the etching solution is not completely removed even after the washing, the neutralizing step S213 of neutralizing the remaining etching solution may be carried out.

The activating step S210 that is a step of adsorbing a metal catalyst in the fine grooves on the surface of the automobile resin part that is formed in the etching step S212, is an activation step of generating, for example, a metal palladium nucleation as the metal catalyst in the fine grooves on the surface, allowing a subsequent chemical plating process to be performed on the surface of the automobile resin part.

The chemical plating step S220 is a step of starting chemical plating by using the palladium nucleated on the surface of the automobile resin part through the pre-treating step as the catalyst and chemical nickel (Ni) to completely fill the fine grooves formed by the etching, forming a film having conductivity to form a conductor capable of performing electroplating.

Next, the electroplating step S230 that is a step of performing plating by using copper (Cu), nickel (Ni), and chromium (Cr), is a step of attaching a current electrode through which current flows on the non-painting portion and performing plating using the current transferred to a current battery.

As illustrated in FIG. 2, for example, in the electroplating step S230, after a copper plating step S231, as an undercoating step, of plating copper (Cu) on the surface of the automobile resin part to serve as a buffer, as a nickel (Ni) plating step S232, primary nickel plating for regulating a thickness of the plating layer and secondary nickel plating for regulating a degree of gloss of a product may be performed. Then, a chromium (Cr) plating step S233, as a finish coating step, of plating chromium (Cr) that is hardly discolored in the atmosphere, has good outside appearance, and has high hardness is performed, such that the electroplating processes are sequentially performed to form the plating layer. Here, as chromium (Cr), trivalent chromium or hexavalent chromium may be used.

Through the wet electroplating as described above, the automobile resin part may have a metallic, elaborate, and clean high-quality outside appearance having good corrosion resistance and good abrasion resistance as well.

By finally washing the product on which the wet electroplating is performed with ion water, stains or foreign materials on the surface of the plated product are removed, and then a drying process including dehydration, hot-air drying, etc may be additionally performed on the finally washed product.

In the wet electroplating step S200, the chemical plating and the electroplating are not performed on the painting portion where the masking paint for plating is applied due to the masking paint for plating, thus the plating layer is not formed on the painting portion.

Hereinafter, an automobile resin part using the foregoing partial plating method of an automobile resin part will be described.

Figure 3:
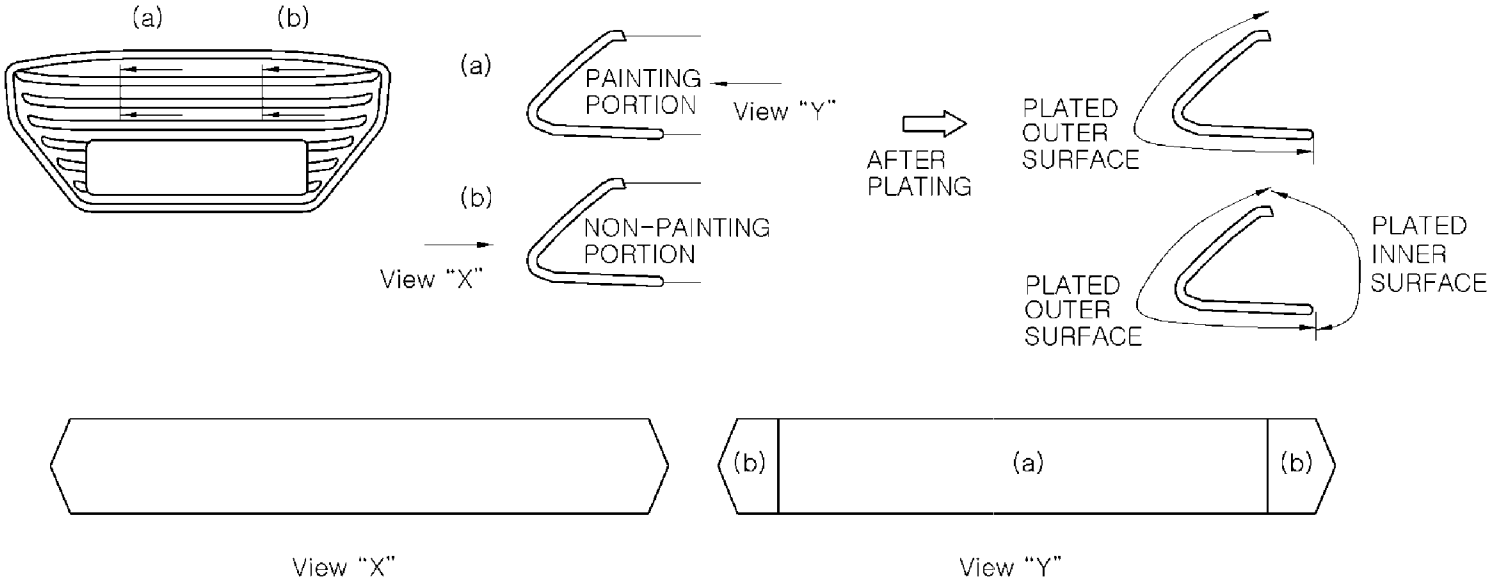
FIG. 3 is a schematic view illustrating an example in which the partial plating method of the present invention is applied to a radiator grille as an automobile resin part.

FIG. 3 illustrates an example in which the partial plating method of the present invention is applied to a radiator grille as an automobile resin part.

Describing cross-sections of a portion (a) and a portion (b) represented as portions of a radiator grille that is an automobile resin part injection-molded using the ABS resin, an inside side of the cross-section of the portion (a) is formed with a painting portion where the masking paint for plating is applied, and an inside side of the cross-section of the portion (b) is formed with a non-painting portion where the masking paint for plating is not applied, as illustrated in FIG. 3. Accordingly, in a case of the portion (a) where the painting portion is formed at the inside side of the cross-section of the part, since the wet electroplating is not performed on the inside surface of the portion (a), only the outside surface thereof that is not painted is plated, and in a case of the portion (b) where the non-painting portion is formed at the inside side of the cross-section of the part, both of the outside surface and the inside surface are plated.

From "X" viewing an outside surface of the portion of the radiator grilled that is partially plated and "Y" viewing an inside surface thereof as illustrated in FIG. 3, it may be appreciated that only the inside surface where the partial painting is performed is partially plated, and the outside surface where the painting portion is not formed is entirely plated.

In the partial painting and partial plating as described above, the suggested outer surface and the inside surface may be reversed to each other, and the present invention is not limited thereto.

Figure 4:
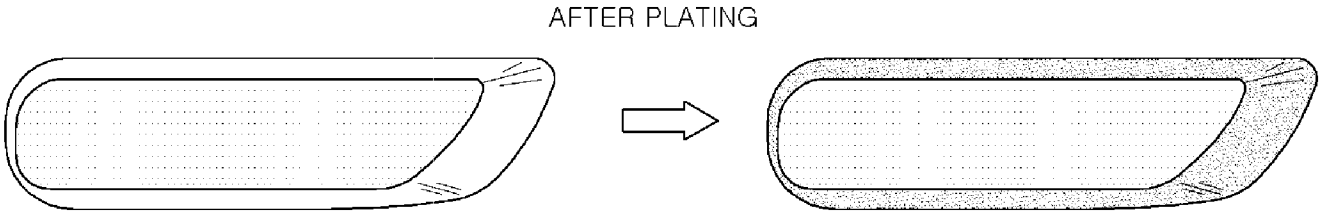
FIG. 4 is a picture of a product plated by using the partial plating method of an automobile resin part in accordance with an exemplary embodiment of the present invention.

FIG. 4 is a picture of an automobile resin part using the partial plating method of an automobile resin part as described above.

The left picture in FIG. 4 shows a case in which the masking paint for plating is partially applied on the surface of the automobile resin part, and the right picture in FIG. 4 shows a case in which the wet electroplating is performed after the masking paint for plating is partially applied.

As shown in FIG. 4, the painting portion that is a portion where the paint is applied is the dotted portion, and it may be appreciated that in a case in which the masking paint for plating is partially applied and then the wet electroplating is performed, the plating is not performed on the portion where the masking paint for plating is applied, and the plating is performed only on the portion where the paint is not applied.

As described above, in the partial plating method of an automobile resin part according to an exemplary embodiment of the present invention, the masking paint for plating that is not chemically plated and electroplated in the wet electroplating process is partially applied only on the area that is not required to be plated to form the plating layer only on the surface except for the painting portion, such that the plating may be more effectively performed on fine portions as compared to the related art, making it possible to manufacture various automobile parts in response to demands of a user and solving the problem of excessively large coating area.

Further, by partially applying the paint and performing the wet electroplating, it is possible to more effectively perform plating on fine portions as compared to the related art, providing automobile resin parts in response to various demands of a user.

According to the partial plating method of an automobile resin part in accordance with the present invention as described above, when dividing an automobile resin part that may have various shapes and is formed of a synthetic resin into a painting portion and a non-painting portion, and partially applying the masking paint for plating on the automobile resin part, and then performing partial plating, since chemical plating and electrical plating are not performed on the painting portion where the masking paint for plating is applied in the wet electroplating process due to the masking paint for plating, the plating layer is not formed on the painting portion, such that the plated area is decreased. As a result, the problem according to the related art that the coating material cost is increased in contrast to the decreased plating cost due to excessively large coating area, may be solved.

Further, by not using separate masking materials for each part, the problem that the plating defect is caused since the electrode for electroplating is not properly attached due to insufficient space when using the masking material according to the relate art, may be solved, and mass production is possible.

Further, by partially applying the paint and performing the wet electroplating, it is possible to more effectively perform plating on fine portions as compared to the related art, providing automobile parts in response to various demands of users and facilitating mass production.

Further, the partial plating method for an automobile resin part according to an exemplary embodiment of the present invention as described above is a technology having high industrial applicability, thus may also be used in different various fields in addition to the field of automobile parts.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A partial plating method of an automobile resin part, including:

a painting step of partially applying masking paint for plating on one side surface of an injection molded automobile resin product to form a painting portion where the masking paint for plating is applied and a non-painting portion where the masking paint for plating is not applied; and a wet electroplating step of attaching a current electrode for wet electroplating on the non-painting portion and performing the wet electroplating to form a plating layer on an entire surface of the automobile resin part except for the painting portion, wherein the masking paint for plating contains a masking resin composition for plating, the masking resin composition for plating contains a polymer resin, an organic solvent, a plasticizer, and an inorganic additive, and wherein the polymer resin is a mixture of poly vinyl chloride (PVC) and an ethylene-vinyl acetate copolymer (EVA), and wherein the plasticizer is trioctyl benzene-1,3,5-tricarboxylate, and wherein the organic solvent includes methyl isobutyl ketone, toluene, n-butanol, and ethyl acetate, and wherein the inorganic additive includes sodium (Na), aluminum (Al), potassium (K), calcium (Ca), titanium (Ti), and iron (Fe).

2. The partial plating method of the automobile resin part of claim 1, wherein in the wet electroplating step, the wet electroplating is not performed on the painting portion.

3. The partial plating method of the automobile resin part of claim 1, wherein in the painting step, the masking paint for plating is applied on a surface of the automobile resin part molded at a thickness of 20 to 30 μm.

4. The partial plating method of the automobile resin part of claim 1, wherein the wet electroplating step includes a pre-treating step of activating chemical plating by adsorbing a metal catalyst so that the chemical plating is performed on a surface of the automobile resin part, a chemical plating step of forming a conductor configured for performing electroplating by using chemical nickel by the metal catalyst, and an electroplating step of plating the automobile resin part gone through the chemical plating step using copper (Cu), nickel (Ni), and chromium (Cr).

5. The partial plating method of the automobile resin part of claim 1, wherein a concentration of the masking resin composition for plating is 60 wt % or more and 99 wt % or less in the masking paint for plating.

* * * * *